US005592722A

United States Patent [19]

Foscaro et al.

[11] Patent Number: 5,592,722

[45] Date of Patent: Jan. 14, 1997

[54] CLOSURE DEVICE, PARTICULARLY FOR SPORTS SHOES

[75] Inventors: Giancarlo Foscaro, Treviso; Mirco Battistella, Spresiano, both of Italy

[73] Assignee: Nordica S.p.A., Trevignano, Italy

[21] Appl. No.: 299,390

[22] Filed: Sep. 1, 1994

[30] Foreign Application Priority Data

Sep. 10, 1993 [IT] Italy ..... TV93A0081

[51] Int. Cl.[6] ..... A43C 11/14

[52] U.S. Cl. ..... 24/68 SK; 36/50.1; 36/50.5; 24/71 SK; 24/69 SK; 24/70 SK; 24/69 ST

[58] Field of Search ..... 24/68 SK, 69 SK, 24/70 SK, 71 SK; 36/50.1, 50.5

[56] References Cited

U.S. PATENT DOCUMENTS

| | | | |
|---|---|---|---|
| 452,851 | 5/1891 | Pullman | 24/70 SK |
| 633,947 | 9/1899 | Bergmani | 24/70 SK X |
| 702,665 | 6/1902 | Mead | 24/70 SK |
| 3,902,226 | 9/1975 | Messenbaugh | 24/70 SK |
| 4,250,595 | 2/1981 | Byrnes | 24/69 SK |
| 4,310,951 | 1/1982 | Riedel | 36/50.1 X |
| 4,449,274 | 5/1984 | Balbinot | 36/50.5 X |

FOREIGN PATENT DOCUMENTS

| | | | |
|---|---|---|---|
| 2005481 | 12/1969 | France | 24/68 SK |
| 413659 | 12/1966 | Switzerland | 24/70 SK |

*Primary Examiner*—Peter M. Cuomo
*Assistant Examiner*—Robert J. Sandy
*Attorney, Agent, or Firm*—Guido Modiano; Albert Josif

[57] ABSTRACT

Closure device particularly for sports shoes including a shell and a quarter and provided with a first flap and a second flap to be secured or with straps to be tensioned and secured. The device includes grip elements and at least one engagement element which are associable respectively with the first flap and with the second flap, or with the shoe and with the band. The grip elements selectively and detachably interact with the engagement element by using an auxiliary lever. The device has low manufacturing costs, allowing to standardize the individual components and limiting protrusions with respect to the surfaces of the shoe.

20 Claims, 2 Drawing Sheets

CLOSURE DEVICE, PARTICULARLY FOR SPORTS SHOES

BACKGROUND OF THE INVENTION

The present invention relates to a closure device particularly for sports shoes comprising a shell and/or at least one quarter provided with a first flap and a second flap to be secured, or with straps to be tensioned and secured.

Various devices are currently known which allow to close a first flap and a second flap of sports shoe, such as for example a ski boot.

Such devices are usually constituted by a lever that comprises a lever body which is pivoted transversely, at one end, at two shoulders that protrude from a base which is rigidly coupled to one of the flaps to be joined.

Said lever body can have, at one of its surfaces, several teeth between which it is possible to engage for example the end of a ring the other end of which is rigidly coupled to the other flap to be joined.

As an alternative, a ring may be pivoted transversely to the lever body, while the other end of the ring is selectively associated at a tooth of a rack which is rigidly coupled to the other flap to be joined.

Devices are also known wherein the arm of the lever is essentially U-shaped, with a bar pivoted between its arms, and wherein a traction element, such as for example a cable, is associated with one end of said bar. The other end of the traction element is associated for example with a ring that selectively interacts with a rack.

These and other conventional devices essentially have the drawback of being constituted by several components which increase their total cost, also bearing in mind the fact that for some shoes, such as for example ski boots or ice skates or roller skates, it is necessary to have multiple closure devices.

In these last cases, it is also necessary to use closure devices which have components with slightly different dimensions, because during securing it is necessary to compensate for a varying amount of space between the flaps to be joined, and to avoid interference between the levers and the ground, in particular for the levers securing the shell portion of the boot.

Therefore, in ski boots and skates, the use of levers at the toe area always entails closure difficulties, as the levers have rather small dimensions, to avoid protruding excessively outside the shell and the user can hardly grip them.

Furthermore, in known closure devices the lever arms are subject to possible accidental impacts during sports practice which either damage the device or open it.

Furthermore, the use of metal to manufacture these conventional closure devices increases the weight and total cost of the shoe.

SUMMARY OF THE INVENTION

The aim of the present invention is to eliminate the drawbacks of the mentioned prior art by providing a device which allows to achieve optimum closure of two flaps or straps of a shoe for securing the foot or leg, at a low manufacturing cost.

Within the scope of the above aim, an important object is to provide a device which allows to standardize the various components regardless of their location on the shoe.

Another important object is to provide a device which allows the user to fasten the shoe with a simple and easy operation.

Another object is to provide a closure device which does not break due to any accidental impacts during sports practice.

Another object is to provide a device which does not open accidentally during sports practice.

Another object is to provide a device which has an extremely limited protrusion with respect to the surfaces of the shoe.

Another object is to provide a closure device which has a low weight.

This aim, these objects and others which will become apparent hereinafter are achieved by a closure device, particularly for sports shoes comprising a shell and at least one quarter provided with a first flap and a second flap to be secured or with a strap to be tensioned and secured, characterized in that it comprises grip elements which are associated with said first flap or with said sports shoes and selectively and detachably interact, by means of an auxiliary lever, with at least one engagement element which is associated with said second flap or with said strap.

BRIEF DESCRIPTION OF THE INVENTION

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figures 1, 2:
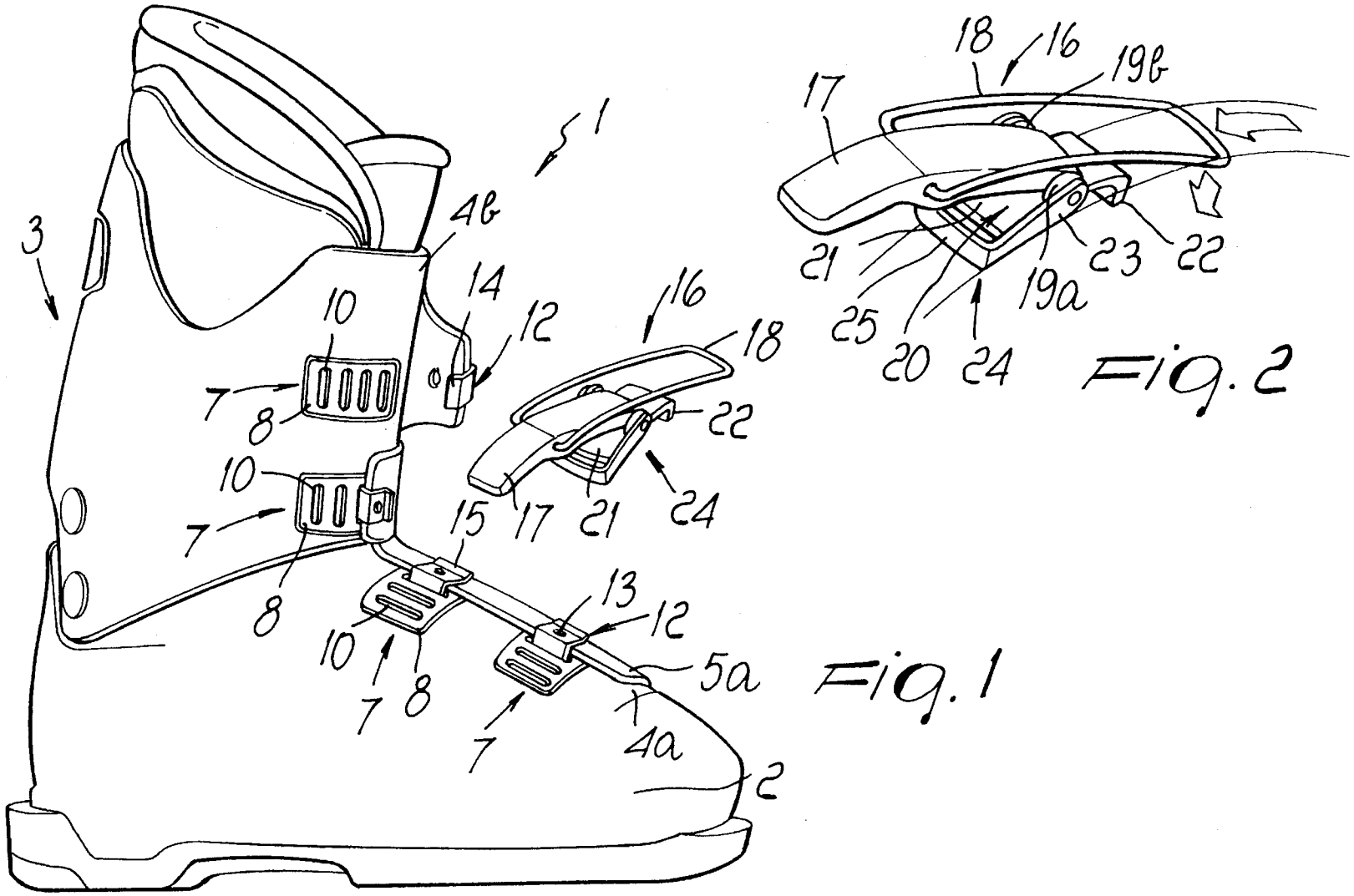
FIG. 1 is a side view of a sports shoe having a closure device according to the invention, showing both the condition in which the flaps are secured and the condition in which the flaps are not secured.
FIG. 2 is a lateral perspective view of the auxiliary lever.
Figure 4:
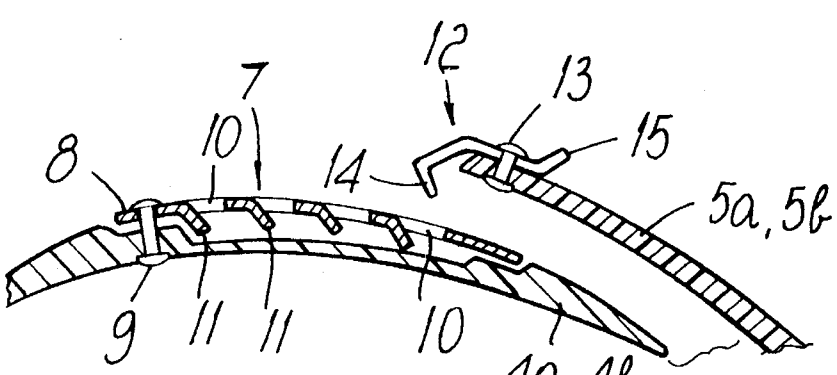
FIG. 4 is a transverse sectional view respectively of a grip element associated with the first flap and of a grip element associated with the second flap.
Figure 5:
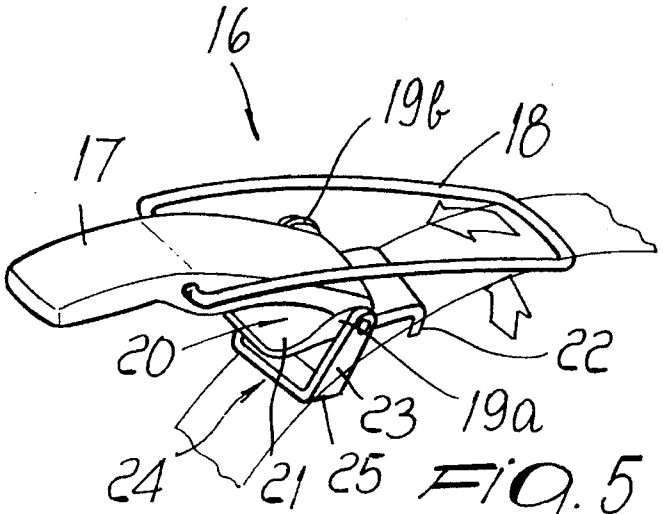
FIG. 5 is a view, similar to FIG. 2, of the use of the auxiliary lever to disengage the grip element and the engagement element.
Figure 3:
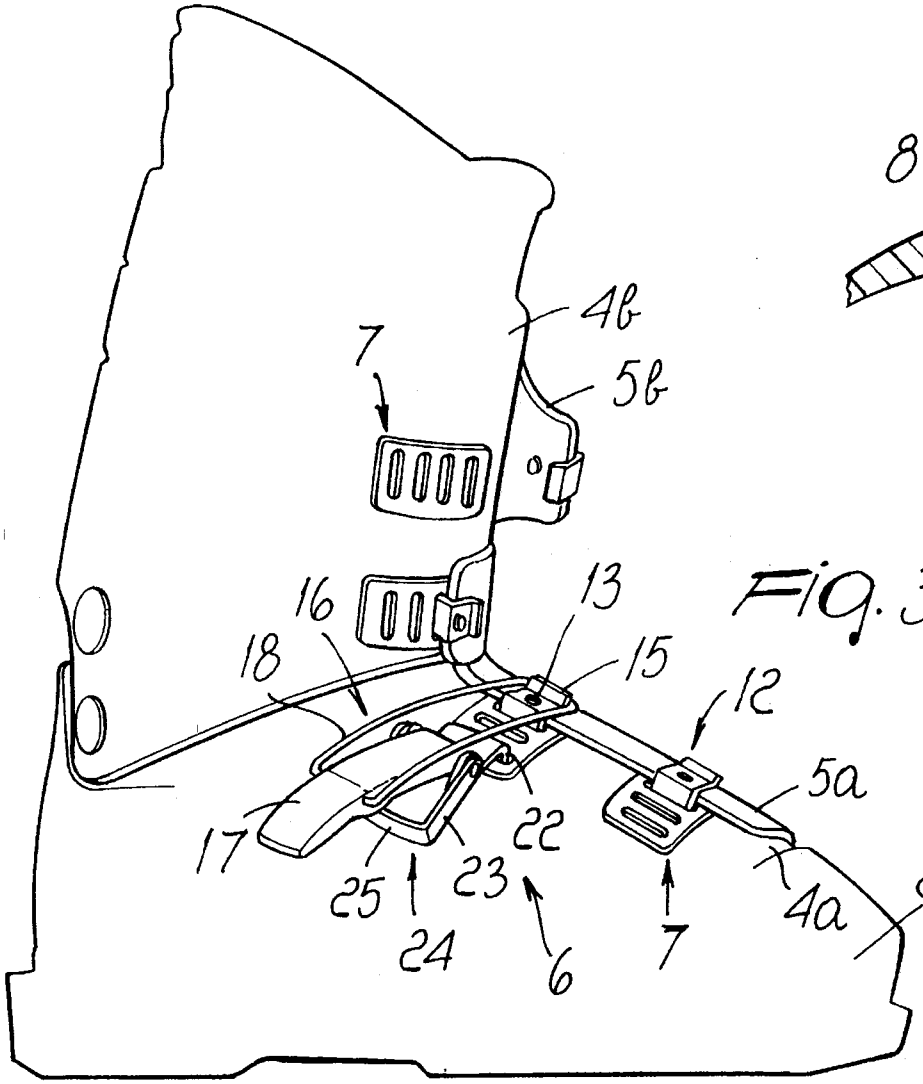
FIG. 3 is a view, similar to FIG. 1, of the use of the auxiliary lever to secure the first and second flaps.

With reference to the above figures, the reference numeral 1 designates a sports shoe, particularly a ski boot, which comprises at least one quarter 3 associated with a shell 2. The shell and the quarter have a first flap *4a*, *4b* and a second flap *5a*, *5b* to be joined.

The closure device, generally designated by the reference numeral 6, is constituted by one or more grip elements, designated by the reference numeral 7, which are constituted by a base 8 which is attached, for example by means of a first rivet 9, proximate to the first flaps *4a* and *4b*, and on which multiple mutually parallel first seats 10 are provided transversely.

A hole is formed at each one of said first seats 10 or, as an alternative, a first tab 11 protrudes thereat towards the facing surface of the first flaps *4a*, *4b*.

The closure device 1 is also constituted by at least one engagement element, generally designated by the reference numeral 12, which is associated at the second flaps 5*a*, 5*b* for example by means of a second rivet 13.

The engagement element is constituted by a pawl which has a first tooth 14 directed towards the first flaps 4*a*, 4*b*.

The dimensions of the first tooth 14 are approximately equal to those of the first seats 10.

On the opposite side with respect to the first tooth 14 there is, on the engagement element 12, a second tooth 15 which protrudes in the opposite direction with respect to the surface of the second flaps 5*a*, 5*b*.

The closure device 6 also comprises an auxiliary lever 16 which is constituted by a lever arm 17 with which a traction element, such as a ring 18 that is temporarily engageable with the surface of the second tooth 15 at its free end, is associated in an intermediate position.

Two shoulders 19*a* and 19*b* are transversely pivoted at one end of said lever arm 17 and protrude at right angles with respect to a freely movable wing 20 which is essentially L-shaped.

The larger portion 21 of the wing 20 oscillates partially below the lever arm 17, and protrudes beyond the axis for pivoting to the arm. Portion 21 is also joined to a smaller portion 22 which is directed opposite with respect to the free end of said lever arm 17.

The smaller portion 22 of the wing 20 forms a third tooth which can be selectively positioned at one of the first seats 10.

The arms 23 of an essentially U-shaped plate 24 are pivoted to the lever arm 17 at the same axis on which the two shoulders 19*a* and 19*b* of the wing 20 are pivoted.

The plate 24, too, is freely pivoted to the lever arm 17 and can oscillate with respect to it. The length of the arms 23 is such as to accommodate between them the part of the larger portion 21 of the wing 20 that lies below the lever arm, when the plate lies adjacent and below the lever arm.

The use of the invention therefore entails that one or more grip elements 7, and a matching number of engagement elements 12, be respectively associated at the first and second flaps of the sports shoe, whereas it is sufficient to have a single auxiliary lever 16 available.

The flaps are then secured in the following manner: initially the user grips the lever arm 17 of the auxiliary lever 16, making the ring 18 interact with the second tooth 15 and placing the smaller portion 22 of the wing 20 in one of the first seats 10 of the corresponding base 8.

In doing so, he makes sure to arrange the plate 24 so that its arms 23 are directed towards the lever arm 17 and below it.

The rotation of the lever arm 17 towards the first flaps subjects the engagement element 12 to traction, making the first tooth 14 interact, optionally in a ratchet-like fashion, with the various first seats 10 of the corresponding base 8.

The arrangement of the auxiliary lever 16 is in fact such that it always pushes the first tooth 14 towards the base 8, and once the lever arm is released, the first tooth 14 allows mutual engagement of the two components at the seat 10 which corresponds to the intended degree of securing.

This operation can be repeated for each one of the engagement elements 12.

Once the flaps have been closed, the auxiliary lever can be easily stored in a pocket or in an adapted seat provided on the sports shoe.

In order to mutually disengage the engagement element and the grip element, it is possible to reposition the lever arm as described above, with the difference that the plate 24 is arranged so that the base 25 that connects the arms 23 rests at the lateral surface of the first flaps 4*a*, 4*b*.

In this way, a rotation of the lever arm 17 again causes traction of the engagement element 12, which however disengages from the first seats 10 due to the elasticity of the second flap which is no longer subjected to any load.

It has thus been observed that the invention has achieved the intended aim and objects, a closure device having been obtained which has a low manufacturing cost since it is constituted by a single auxiliary lever and by highly simplified engagement and grip elements which can furthermore be standardized in their dimensions, so that they can be applied to any area of the sports shoe.

The auxiliary lever 16 can also have such dimensions as to allow the easy tensioning and release of the engagement element, for example by providing an oversized lever arm 17.

Once the flaps have been secured and the auxiliary lever 16 has been stored, the sports shoe features very limited protrusions with respect to the flaps; these protrusions are constituted only by the second tooth 15 of the engagement element, so as to eliminate at the same time any possibility of interference with the ground, the possibility of breakage of the various components, due to accidental impacts during sports practice, and any possibility of accidental opening due to such impacts.

Because of the limited protrusion of its elements, the sports shoe therefore has a better performance and an improved aesthetical appearance.

Finally, since the auxiliary lever can be stored temporarily, the closure device has an extremely limited weight that allows to lighten the sports shoe.

The closure device according to the present invention is naturally susceptible of numerous modifications and variations, all of which are within the scope of the same inventive concept.

Thus, for example, the base 8 may have a single seat 10 and the engagement element 12 may be provided with multiple first teeth 14. In this case, of course, the seat 10 protrudes with respect to the profile of the shoe instead of being recessed, and it is necessary to provide another seat on the boot for engagement with the smaller portion 22 of the auxiliary lever 16.

The same device may also be used for straps suitable to secure the leg or the foot inside or outside the sports shoe.

In this case the grip element is nonetheless provided on the shell or on the quarter, while the engagement element must be located at the end of the strap.

Finally, in the same manner the materials, as well as the dimensions, that constitute the individual components of the device may also be the most pertinent according to the specific requirements.

What is claimed is:

1. Closure device for releasably mutually securing a first portion and a second portion of a sports shoe, wherein the closure device comprises grip elements which are associable with the first portion and which selectively and detachably interact, by means of an auxiliary lever, with at least one engagement element which is associable with the second portion, and wherein each of said grip elements comprises a base which is associable with the first portion, multiple mutually parallel first seats being provided transversely on said base, and wherein a first tab protrudes at each one of said first seats towards a facing surface of said first portion, and wherein said engagement element is constituted by a pawl which has a first tooth directed towards said first portion when said first tooth selectively and detachably interacts with a respective first seat.

2. Device according to claim 1, wherein a hole is formed at each one of said first seats.

3. Device according to claim 1, wherein the dimensions of said first tooth are approximately equal to those of said first seats of said base.

4. Device according to claim 3, wherein a second tooth is provided on an opposite side with respect to said first tooth on said at least one engagement element, said second tooth protruding in an opposite direction with respect to a facing surface of said second portion.

5. Device according to claim 4, comprising a single auxiliary lever that can be detached from said sports shoe and is constituted by a lever arm with which a traction element, such as a ring which can temporarily engage said second tooth at a free end of the ring, is associated in an intermediate position.

6. Device according to claim 5, wherein two shoulders are pivoted transversely at one end of said lever arm and protrude at right angles with respect to a freely movable wing which is essentially L-shaped.

7. Device according to claim 6, wherein a larger portion of said wing oscillates partially below said lever arm, protrudes beyond an axis for pivoting to said lever arm, and is joined to a smaller portion which is directed opposite to a free end of said lever arm.

8. Device according to claim 7, wherein said smaller portion of said wing forms a third tooth which can be selectively located at one of said first seats.

9. Device according to claim 8, wherein arms of an essentially U-shaped plate are freely pivoted to said lever arm at said axis on which said pair of shoulders of said wing is pivoted.

10. Device according to claim 9, wherein the length of said arms is such as to accommodate, between said arms, a part of said larger portion of said wing that lies below said lever arm when said plate lies adjacent and below said lever arm.

11. A closure device for releasably securing a first portion and a second portion of a sports shoe, the closure device comprising:

a grip element rigidly and non-pivotally connectable with the first portion of the sports shoe;

an engagement element rigidly and non-pivotally connectable with the second portion of the sports shoe;

a plurality of selectable detachable engagement positions between said grip element and said engagement element, each of said selectable detachable engagement positions comprising a releasable arrangement of a tooth element rigidly and non-pivotally formed at one of said grip and engagement elements which is detachably engaged in abutment with a holding element rigidly and non-pivotally formed at the other of said grip and engagement elements such as to selectively and mutually releasably secure the first and second portions of the sports shoe;

a lever device adapted for engaging said engagement element such as to move said engagement element relative to said grip element to selectively form a selected one of said plurality of engagement positions between said grip and engagement elements, said lever device being detachable from said sports shoe and comprising a pivoting lever arm and a traction element connected to said pivoting lever arm such that said traction element is engageable with said engagement element while simultaneously a pivoting action of said lever arm selectively forms said selected one of said plurality of engagement positions between said grip and engagement elements, said lever device being detachable from said sports shoe such that after said selected one of said plurality of engagement positions between said grip and engagement elements is formed said lever device is detachable from said sports shoe.

12. A closure device for releasably securing a first portion and a second portion of a sports shoe, the closure device comprising:

a grip element connectable with the first portion of the sports shoe;

an engagement element connectable with the second portion of the sports shoe;

a plurality of selectable detachable engagement positions between said grip element and said engagement element, each of said selectable detachable engagement positions comprising a releasable arrangement of a tooth element formed at one of said grip and engagement elements which is detachably engaged in abutment with a holding element formed at the other of said grip and engagement elements such as to selectively and mutually releasably secure the first and second portions of the sports shoe;

a lever device adapted for engaging said engagement element such as to move said engagement element relative to said grip element to selectively form a selected one of said plurality of engagement positions between said grip and engagement elements, said lever device being detachable from said sports shoe and comprising a pivoting lever arm and a traction element connected to said pivoting lever arm such that said traction element is engageable with said engagement element while simultaneously a pivoting action of said lever arm selectively forms said selected one of said plurality of engagement positions between said grip and engagement elements, said lever device being detachable from said sports shoe such that after said selected one of said plurality of engagement positions between said grip and engagement elements is formed said lever device is detachable from said sports shoe;

wherein said lever device further comprises a wing element pivoted to said lever arm and adapted for engaging an abutment element of said grip element which holds the wing element during the pivoting action of said lever arm.

13. The closure device of claim 12 wherein said grip element comprises a series of parallel seats and wherein said engagement element comprises said tooth element, said tooth element being selectively detachably engageable in one of said parallel seats such as to selectively form one of said engagement positions between said grip element and said engagement element, each one of said parallel seats comprising a respective said holding element for a respective one of said engagement positions, and said parallel seats further comprising said abutment element for said wing element of said lever device.

14. The closure device of claim 13 wherein said grip element comprises a base element having a series of tabs for protruding from said base element towards said first portion of the sports shoe and which form said series of parallel seats.

15. The closure device of claim 12 wherein said lever device further comprises a plate element pivoted to said lever arm and arranged below said wing element for selective abutment with the first portion of the sports shoe for aiding in disengaging said tooth element from said holding element.

16. A closure device for releasably securing a first portion and a second portion of a sports shoe, the closure device comprising:

a grip element rigidly and non-pivotally connectable with the first portion of the sports shoe;

an engagement element rigidly and non-pivotally connectable with the second portion of the sports shoe;

a plurality of selectable detachable engagement positions between said grip element and said engagement element, each of said selectable detachable engagement positions comprising a releasable arrangement of a tooth element rigidly and non-pivotally formed at one of said grip and engagement elements which is detachably engaged in abutment with a holding element rigidly and non-pivotally formed at the other of said grip and engagement elements such as to selectively and mutually releasably secure the first and second portions of the sports shoe;

a lever means for engaging said engagement element such as to move said engagement element relative to said grip element to selectively form a selected one of said plurality of engagement positions between said grip and engagement elements, said lever means being detachable from said sports shoe and comprising a pivoting lever arm and a traction element connected to said pivoting lever arm such that said traction element is engageable with said engagement element while simultaneously a pivoting action of said lever arm selectively forms said selected one of said plurality of engagement positions between said grip and engagement elements, said lever means being detachable from said sports shoe such that after said selected one of said plurality of engagement positions between said grip and engagement elements is formed said lever means is detachable from said sports shoe.

17. A closure device for releasably securing a first portion and a second portion of a sports shoe, the closure device comprising:

a grip element connectable with the first portion of the sports shoe;

an engagement element connectable with the second portion of the sports shoe;

a plurality of selectable detachable engagement positions between said grip element and said engagement element, each of said selectable detachable engagement positions comprising a releasable arrangement of a tooth element formed at one of said grip and engagement elements which is detachably engaged in abutment with a holding element formed at the other of said grip and engagement elements such as to selectively and mutually releasably secure the first and second portions of the sports shoe;

a lever means for engaging said engagement element such as to move said engagement element relative to said grip element to selectively form a selected one of said plurality of engagement positions between said grip and engagement elements, said lever means being detachable from said sports shoe and comprising a pivoting lever arm and a traction element connected to said pivoting lever arm such that said traction element is engageable with said engagement element while simultaneously a pivoting action of said lever arm selectively forms said selected one of said plurality of engagement positions between said grip and engagement elements, said lever means being detachable from said sports shoe such that after said selected one of said plurality of engagement positions between said grip and engagement elements is formed said lever means is detachable from said sports shoe;

wherein said lever means further comprises a wing element pivoted to said lever arm and adapted for engaging an abutment element of said grip element which holds the wing element during the pivoting action of said lever arm.

18. The closure device of claim 17 wherein said grip element comprises a series of parallel seats and wherein said engagement element comprises said tooth element, said tooth element being selectively detachably engageable in one of said parallel seats such as to selectively form one of said engagement positions between said grip element and said engagement element, each one of said parallel seats comprising a respective said holding element for a respective one of said engagement positions, and said parallel seats further comprising said abutment element for said wing element of said lever means.

19. The closure device of claim 18 wherein said grip element comprises a base element having a series of tabs for protruding from said base element towards said first portion of the sports shoe and which form said series of parallel seats.

20. The closure device of claim 17 wherein said lever means further comprises a plate element pivoted to said lever arm and arranged below said wing element for selective abutment with the first portion of the sports shoe for aiding in disengaging said tooth element from said holding element.

* * * * *